US007339337B2

(12) United States Patent
Lewis

(10) Patent No.: US 7,339,337 B2
(45) Date of Patent: Mar. 4, 2008

(54) POWER PLANT

(75) Inventor: Eric Anthony Lewis, Rugby (GB)

(73) Assignee: Converteam Ltd, Warwickshire (GB)

( * ) Notice: Subject to any disclaimer, the term of this patent is extended or adjusted under 35 U.S.C. 154(b) by 379 days.

(21) Appl. No.: 11/087,176

(22) Filed: Mar. 23, 2005

(65) Prior Publication Data

US 2005/0221697 A1 Oct. 6, 2005

(30) Foreign Application Priority Data

Mar. 25, 2004 (GB) ..... 0406767.4
Apr. 7, 2004 (GB) ..... 0407997.6

(51) Int. Cl.
*H02P 7/00* (2006.01)

(52) U.S. Cl. ..... 318/432; 318/431; 318/433; 318/434

(58) Field of Classification Search ..... 318/432, 318/431, 433, 434, 86, 703, 717, 741, 269, 318/362, 465; 475/5
See application file for complete search history.

(56) References Cited

U.S. PATENT DOCUMENTS 3,478,622 A 11/1969 Reid
3,618,719 A 11/1971 Marland
5,647,780 A 7/1997 Hosoi
6,726,588 B2 * 4/2004 Weisz ..... 475/5

FOREIGN PATENT DOCUMENTS

| | | |
|---|---|---|
| DE | 32 02 988 A1 | 8/1983 |
| DE | 102 17 887 A1 | 11/2003 |
| GB | 2 082 533 A | 3/1982 |
| JP | 9-301275 | 11/1997 |

* cited by examiner

*Primary Examiner*—Karen Masih
(74) *Attorney, Agent, or Firm*—Kirschstein, et al.

(57) ABSTRACT

A propeller is driven by an electric motor through a mechanical drive train. The output torque of the motor to the drive train is controlled by a controller with respect to a normal torque reference signal and an emergency torque reference signal. When a measured deceleration of the motor exceeds a threshold deceleration value, the normal torque reference signal is modified or replaced by the emergency torque reference signal and the controller signals the motor to reduce or reverse the torque applied to the mechanical drive train by the motor. In this way, the integrity of the propeller and drive train can be protected if the propeller strikes an underwater obstruction.

10 Claims, 2 Drawing Sheets

POWER PLANT

FIELD OF THE INVENTION

The present invention relates to a power plant system comprising a propeller, a mechanical drive train, an electric motor, and an electronic controller for the motor. In particular, the invention relates to a means of protecting the propeller and the mechanical drive train from the full effect of mechanical shocks resulting from sudden cessation of propeller motion, such as is caused by fouling of the propeller by an underwater obstacle.

DESCRIPTION OF THE RELATED ART

Older types of mechanically driven (turbine or internal combustion engine) icebreaker vessels have used a drive train comprising a propeller on a shaft driven directly from the mechanical power plant. In such icebreakers, the integrity of the propeller and drive train can be put at risk if the propeller hits a large block of ice, since it may be forced to stop very rapidly (say, in 0.5 seconds) against the torque delivered by the power plant, thereby putting an unacceptably large mechanical shock loading on the propeller and the drive train.

FIG. 1 indicates that to solve this so-called "ice stalling" problem, a fluid coupling 10, such as a Voith (RTM) turbo fluid coupling, has been used between the ends of two shafts 12A, 12B in the drive train to absorb the sudden change in speed between the mechanical plant 14 and the propeller 16 and thereby avoid over-stressing the system.

In other more recent types of icebreaker, in which an electric motor is directly coupled to the propeller through a shaft, there has been less need to interpose fluid couplings in the drive train because the electric motor has the ability to stop rotating very rapidly, unlike a turbine or diesel engine. Nevertheless, the propeller shaft still has to be rated for the forces caused by the stopping of the electric motor's rotary inertia. This is true no matter whether the motor and drive train is mounted in the hull of the vessel, or in a propulsion pod outside the main hull.

However, it has recently been proposed to use so-called "thrusters" for icebreakers, see FIG. 2. As shown, in a typical thruster configuration, a high speed motor 20 drives the propeller 21 through three shafts 22, 23, 24 and two sets of gearing 25, 26. The motor 20 is housed within the hull 27 of the vessel, while the propeller 21 is mounted on a horizontal axis at the lower end of a swivelling stay 28 that projects downwards from the hull. The stay is joined to the hull in the horizontal plane of a coupling 29 which allows the stay to rotate about a vertical axis centered on vertical shaft 23 and thereby change the direction of thrust of the propeller. The gearing 25, 26 is of course necessitated by the need to transfer the drive from the hull-mounted horizontal shaft 22, through the vertical shaft 23, to the horizontal propeller shaft 24 at the bottom of the stay.

It is desirable to reduce the size of the motor by using step-down gearing, thereby allowing the motor to run at a higher RPM than the propeller. Unfortunately, this may expose the propeller to excessive torsional shock load, by virtue of the disproportionate effect of the gearing, because when referring a particular component of shaft system inertia to the propeller via step down gears of speed ratio N, the inertia experienced by the propeller is effectively multiplied by $N^2$. Thus, the drive train with its gearing magnifies the motor's rotary inertia, as seen by the propeller, and increases the forces on the shaft and gears in an ice-stalling or other propeller-fouling event. To avoid damage to the propeller and drive train, a fluid coupling can again be inserted between the electric motor and the gears.

Unfortunately, such fluid couplings incur significant power transfer efficiency losses, which wastes fuel and energy.

SUMMARY OF THE INVENTION

The present invention provides anti-shock control in thrusters or other electric motor propulsion systems used in icebreakers and other water-borne vessels, so that they are better adapted to withstand stalling shocks to the drive train, caused by fouling of the propeller.

According to the present invention, a power plant system comprises a propeller, a mechanical drive train, an electric motor, means for controlling output torque of the motor to the drive train, and an emergency motor torque control means, the emergency motor torque control means comprising:

means for detecting excessive deceleration of the motor, and means operative to reduce or reverse the torque applied to the mechanical drive train by the motor if excessive deceleration is detected.

In this way, deceleration of the motor is increased beyond that of the drive train, so reducing the shock to the propeller and drive train if rotation of the propeller is excessively impeded. It will be appreciated that in the severe case of the propeller striking a solid underwater obstruction, such as a large block of ice, the invention protects the integrity of the propeller and drive train by reducing the amount of rotational stored energy transferred into the obstruction.

The means for controlling motor output torque preferably comprises an electronic vector controller and means inputting a torque reference signal to the controller, the torque reference signal being representative of a desired motor output torque. Hence, the means operative to reduce or reverse the torque applied to the mechanical drive train by the motor may conveniently comprise means for changing the torque reference signal to a low or a negative value.

The means for detecting excessive deceleration of the motor may comprise means for sensing deceleration of the motor, means for comparing sensed deceleration values with a threshold value representing an excessive deceleration and means for generating a signal indicative of excessive deceleration if a sensed deceleration exceeds the threshold value.

The means for changing the torque reference input signal to a low or a negative value may comprise means for modifying or replacing the torque reference input signal upon receipt of the above signal indicative of excessive deceleration. In a preferred embodiment, the means for inputting a torque reference signal to the controller comprises (a) a signal summing means operative to receive a normal torque reference signal and an emergency torque reference signal and output the sum of the signals to the controller, and (b) switch means operative to input the emergency torque reference signal to the signal summing means only when the switch means receives the above signal indicative of excessive deceleration.

The invention also embraces a method of emergency control of a power plant in which an electric motor drives a propeller through a mechanical drive train, the method comprising the steps of:

detecting excessive deceleration of the motor, and reducing or reversing the torque being applied to the mechanical drive train by the motor if excessive deceleration is detected.

Further aspects of the invention will be apparent from the following description and claims.

BRIEF DESCRIPTION OF THE DRAWINGS

Exemplary embodiments of the invention will now be described with reference to the accompanying drawings, in which.

DETAILED DESCRIPTION OF A PREFERRED EMBODIMENT

Figure 1:
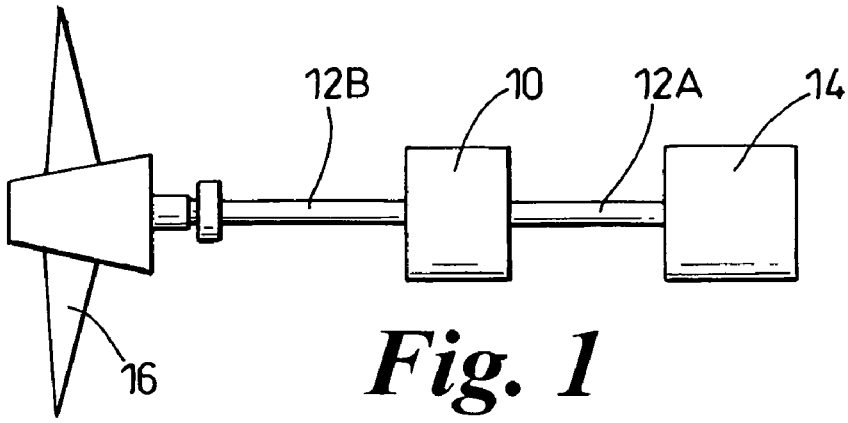
Fig. 1 (Prior Art)
FIG. 1 diagrammatically illustrates a prior art arrangement of a propeller drive train employing a fluid coupling.
Figure 2:
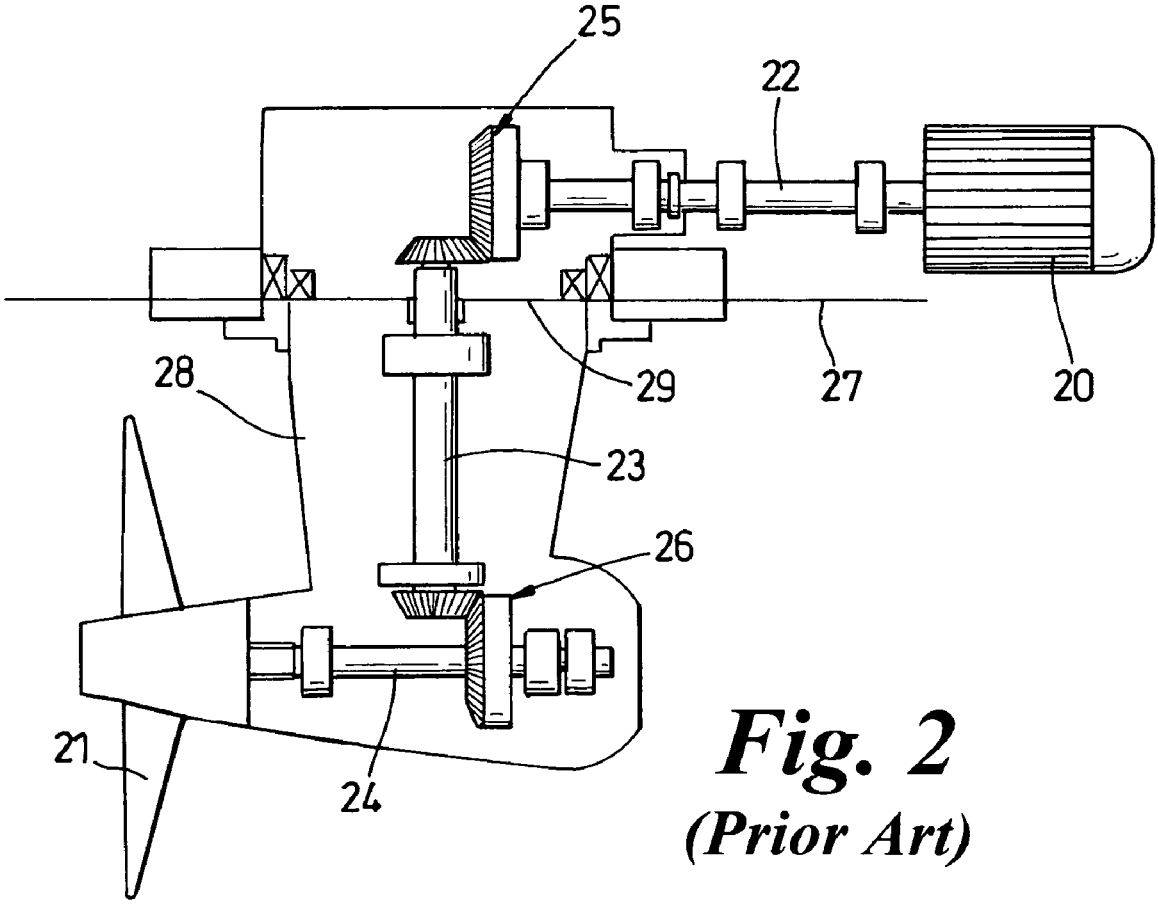
Fig. 2 (Prior Art)
FIG. 2 diagrammatically illustrates a known type of thruster system in which an electric motor drives a propeller through a geared mechanical drive train.
Figure 3:
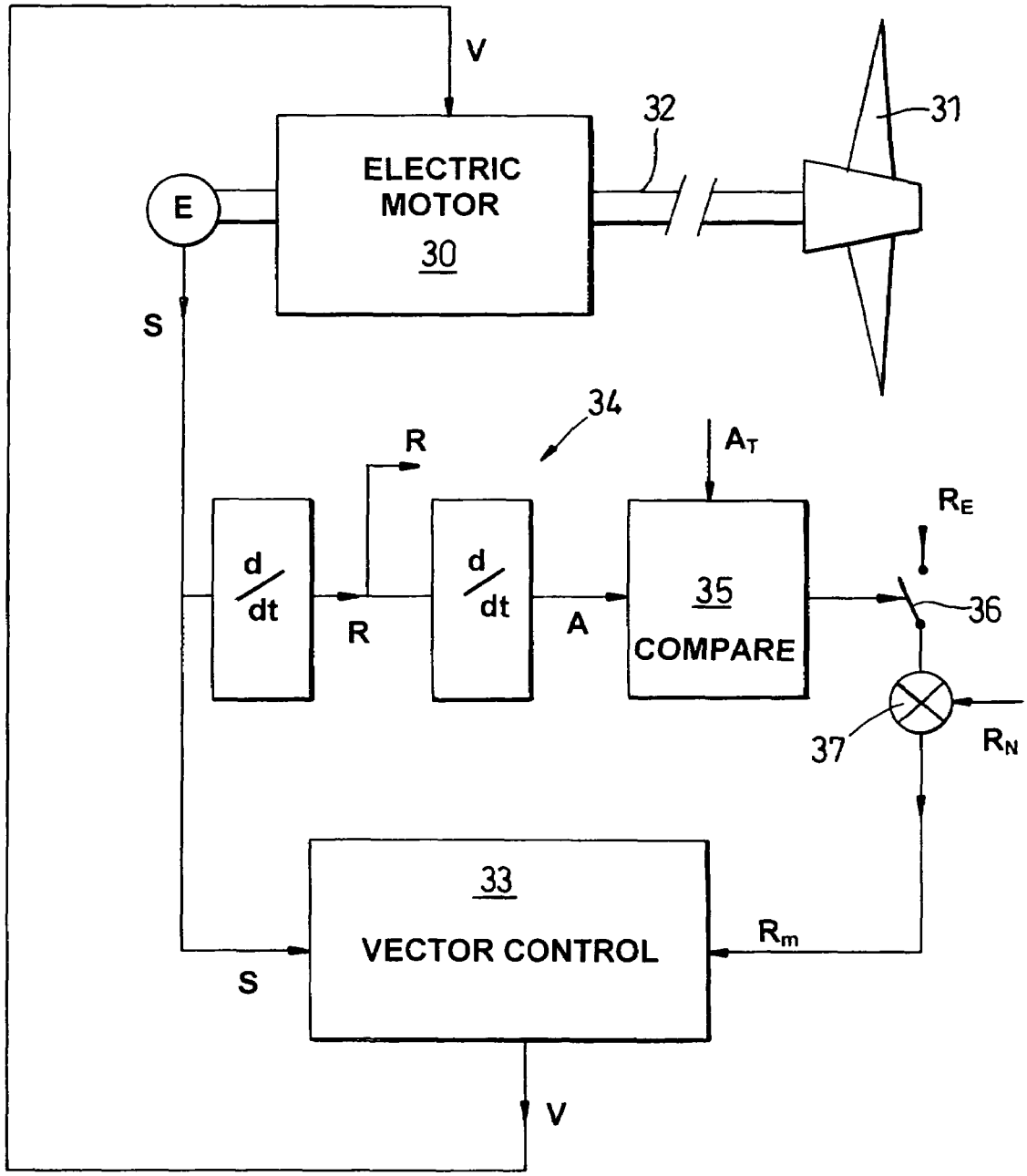
FIG. 3 is a simplified block diagram of an embodiment of the invention suitable for use in conjunction with a thruster arrangement such as is shown in FIG. 2.

Referring to FIG. 3, reference 30 indicates a shipboard electric motor with its associated electrical/electronic components. The latter are assumed to include a PWM (Pulse Width Modulated) converter for converting electrical current from a generator (not shown) into a form suitable for energizing the stator coils of the electric motor. Motor 30 drives a propeller 31 through what could be a complex geared drive train 32 such as is shown in FIG. 2, but which is here signified simply by portions of a propeller shaft. In brief, in this embodiment of the invention, the output torque of the motor to the drive train is controlled by a controller 33 with respect to a normal or desired torque reference signal $R_N$ and an emergency torque reference signal $R_E$. When a measured deceleration A of the motor exceeds a threshold deceleration value AT, the normal torque reference signal $R_N$ is modified or replaced by the emergency torque reference signal $R_E$ and the controller (33) signals the motor (30) to reduce or reverse the torque applied to the mechanical drive train by the motor. In this way, the integrity of the propeller and drive train can be protected if the propeller strikes an underwater obstruction.

The torque applied by the electric motor 30 to the drive train 32 during normal operation of the system is set by a known type of vector control performed by the controller 33. The system uses encoder shaft position sensing, as known, to effect vector control of the motor, also known in itself. Motor shaft position information from an encoder E is used to facilitate high-bandwidth field-oriented control in the vector controller 33, which in turn regulates the torque applied by the motor 30. Hence, a motor shaft position signal S is produce by a shaft position encoder E (known per se) and input to the controller 33 together with a normal reference signal $R_N$ which represents a desired torque to be produced by the motor. These inputs are utilized by the controller to produce output signals V for driving the above-mentioned PWM converter, by means of which the motor's output torque is varied.

At all times during normal operation of the propulsion system, the rate of change of motor speed is monitored by a monitor subsystem 34. In software or otherwise, the shaft position signal S from the encoder E is differentiated twice ($d/dt^2$). The first differentiation produces a shaft rotational speed signal R, which may be used later as described below, and the second differentiation produces a shaft rotational acceleration/deceleration signal A. This signal A is fed to a comparator 35, where it is compared with a deceleration threshold signal $A_T$. $A_T$ represents an excessive deceleration of the motor speed, indicative of an external obstruction or fouling of the propeller, such as by the propeller striking a large block of ice. If comparator 35 detects that deceleration threshold $A_T$ has been exceeded, the comparator triggers (e.g., by means of a software or hardware switch 36) the input of an emergency torque reference signal $R_E$ to a summing junction 37. Summing of the signal $R_E$ with the normal torque reference signal $R_N$ produces a modified torque reference signal $R_M$.

Alternatively, the emergency torque reference signal $R_E$ may simply temporarily replace the normal reference signal $R_N$, making $R_M$=$R_E$.

By setting the emergency torque reference $R_E$, to an appropriate low or negative value, the transfer of rotational stored energy into the obstruction can be reduced. For example, if on detection of the obstruction the emergency torque reference $R_E$ (or $R_M$ if modified by summing with $R_N$) is set to maximum deceleration, the energy transferred to the obstruction will be minimized. Effectively, the system achieves a synthetic reduction of drive train inertia.

When the shaft stops, or if the ice load is removed, then the fast rate of fall in speed will cease and normal operation can continue.

It should be realized that $A_T$ or indeed $R_E$ need not be a fixed values. For instance, $R_E$ may be a torque/time characteristic and both or either may be programmable to vary as functions of one or more characteristics of the drive, such as shaft rotational speed immediately before the activating deceleration. In this way, one could achieve the effect that the greater the speed of the motor prior to the event, the greater the reverse torque applied by the motor and hence the greater the retardation applied to the motor end of the propeller drive train to act against the deceleration shock produced by fouling of the propeller.

In the above system, the control of the motor's torque can be either open loop or closed loop.

A simulation has found that the control method of the invention reduces the mechanical stress levels in the propeller shaft by typically 2:1. One of the advantages of the invention is that it will allow faster motors to be used, without danger of damaging the drive train. Note that high-speed motors are lower in cost than slow-speed motors. Lower cost gears and shafts can also be used.

The method also allows higher torque to be used at low speeds for slowly applied loads.

I claim:

1. A power plant system, comprising:

a) a propeller;

b) a mechanical drive train;

c) an electric motor;

d) means for controlling output torque of the motor to the drive train; and e) an emergency motor torque control means including means for detecting excessive deceleration of the motor, and means operative to reduce or reverse the torque applied to the mechanical drive train by the motor if excessive deceleration is detected, the means for detecting excessive deceleration of the motor comprising means for sensing deceleration of the motor, means for comparing sensed deceleration values with a threshold value representing an excessive deceleration, and means for generating a signal indicative of excessive deceleration if a sensed deceleration exceeds the threshold value.

2. The power plant system according to claim 1, in which the motor torque control means comprises an electronic vector controller and means inputting a torque reference signal to the controller.

3. The power plant system according to claim 2, in which the means operative to reduce or reverse the torque applied to the mechanical drive train by the motor comprises means for changing the torque reference signal to a lower value or a negative value, respectively.

4. The power plant system according to claim 3, in which the means for changing the torque reference signal to a lower or a negative value comprises means for modifying or replacing the torque reference input signal upon receipt of the signal indicative of excessive deceleration.

5. The power plant system according to claim 4, in which the means for inputting a torque reference signal to the controller comprises signal summing means operative to receive a normal torque reference signal and an emergency torque reference signal, and to output a sum of the signals to the controller, and switch means operative to input the emergency torque reference signal to the signal summing means only when the switch means receives the signal indicative of excessive deceleration.

6. A method of emergency control of a power plant in which an electric motor drives a propeller through a mechanical drive train, the method comprising the steps of:

a) detecting excessive deceleration of the motor by sensing deceleration of the motor, comparing sensed deceleration values with a threshold value representing an excessive deceleration, and generating a signal indicative of excessive deceleration if a sensed deceleration exceeds the threshold value; and b) reducing or reversing the torque being applied to the mechanical drive train by the motor if excessive deceleration is detected.

7. The method of emergency control of a power plant according to claim 6, in which the motor output torque is controlled by an electronic vector controller in accordance with a torque reference signal input to the controller.

8. The method of emergency control of a power plant according to claim 7, in which the torque applied to the mechanical drive train by the motor is reduced or reversed by changing the torque reference signal to a lower value or a negative value, respectively.

9. The method of emergency control of a power plant according to claim 8, in which the torque reference input signal is changed to a lower or a negative value by modifying or replacing the torque reference input signal upon receipt of the signal indicative of excessive deceleration.

10. The method of emergency control of a power plant according to claim 9, in which the torque reference signal is derived by summing a normal torque reference signal and an emergency torque reference signal only when excessive deceleration is detected.

* * * * *